US011085695B2

(12) United States Patent
von Bargen

(10) Patent No.: US 11,085,695 B2
(45) Date of Patent: Aug. 10, 2021

(54) TREATMENT PLANT AND METHOD FOR TREATING WORKPIECES

(71) Applicant: EISENMANN SE, Böblingen (DE)

(72) Inventor: Jonas von Bargen, Stuttgart (DE)

(73) Assignee: EISENMANN SE, Böblingen (DE)

( * ) Notice: Subject to any disclaimer, the term of this patent is extended or adjusted under 35 U.S.C. 154(b) by 106 days.

(21) Appl. No.: 16/459,988

(22) Filed: Jul. 2, 2019

(65) Prior Publication Data

US 2020/0011599 A1 Jan. 9, 2020

(30) Foreign Application Priority Data

Jul. 5, 2018 (DE) ..... 10 2018 116 358.4

(51) Int. Cl.
*F26B 21/04* (2006.01)
*B05C 11/00* (2006.01)
(Continued)

(52) U.S. Cl.
CPC ..... *F26B 21/04* (2013.01); *B05C 11/00* (2013.01); *B05D 3/0413* (2013.01); *F26B 15/14* (2013.01);
(Continued)

(58) Field of Classification Search
CPC ..... F26B 21/04; F26B 21/004; F26B 21/12; F26B 25/18; F26B 2210/10;
(Continued)

(56) References Cited

U.S. PATENT DOCUMENTS 1,424,969 A * 8/1922 White ..... F26B 15/14 427/374.1
2,100,838 A * 11/1937 De Vout ..... F26B 15/14 34/223
(Continued)

FOREIGN PATENT DOCUMENTS

DE 20 2017 106 843 11/2017
DE 20 2018 100 210 3/2018
(Continued)

*Primary Examiner* — Stephen M Gravini
(74) *Attorney, Agent, or Firm* — Schroeder Intellectual Property Law Group, LLC

(57) ABSTRACT

A treatment plant and method for treating workpieces, in particular for coating and/or drying vehicle bodies, having a treatment device with a housing in which a treatment space is accommodated. A conveyor system having a multitude of transport trolleys for conveying workpieces through the treatment space, wherein each transport trolley has a chassis and a fastening device for at least one workpiece, which are coupled together by means of a connecting device. Outside the treatment space, there is a guiding area with a travel space for the chassis. The travel space is connected to the treatment space via a connecting passage such that the chassis of a transport trolley can move in the travel space and at the same time the fastening device is entrained in the treatment space and the connecting device extends through the connecting passage. The travel space is defined by a travel space housing and a gas device is present to feed a throughflow gas, in particular air, to the travel space. At least a major part of the throughflow gas can again be discharged from the travel space as exhaust gas, without this throughflow gas reaching the treatment space through the connecting passage.

19 Claims, 6 Drawing Sheets

(51) Int. Cl.

| | |
|---|---|
| ***B05D 3/04*** | (2006.01) |
| ***F26B 15/14*** | (2006.01) |
| ***F26B 21/12*** | (2006.01) |
| ***F26B 21/00*** | (2006.01) |
| ***F26B 25/18*** | (2006.01) |

(52) U.S. Cl.
CPC ..... *F26B 21/004* (2013.01); *F26B 21/12* (2013.01); *F26B 25/18* (2013.01); *F26B 2210/12* (2013.01)

(58) Field of Classification Search
CPC ..... F26B 2210/12; F26B 15/14; B05C 11/00; B05D 3/0413; B05D 2/0413
USPC ..... 34/500
See application file for complete search history.

(56) References Cited

U.S. PATENT DOCUMENTS

| | | | | | |
|---|---|---|---|---|---|
| 3,429,057 | A * | 2/1969 | Thygeson, Sr. | F26B 21/004 | 34/656 |
| 4,769,925 | A * | 9/1988 | Matsubara | F26B 21/04 | 118/326 |
| 5,113,600 | A * | 5/1992 | Telchuk | F26B 21/04 | 34/90 |
| 5,160,040 | A * | 11/1992 | Odawara | B05B 16/80 | 210/167.31 |
| 5,619,808 | A * | 4/1997 | Pabst | D06C 3/02 | 34/640 |
| 7,600,329 | B2 * | 10/2009 | Ortlieb | B65G 13/02 | 34/666 |
| 8,875,414 | B2 * | 11/2014 | Blomquist | F26B 3/04 | 34/396 |
| 9,841,234 | B2 * | 12/2017 | Stahl | F26B 3/04 | |
| 10,161,680 | B2 * | 12/2018 | Caro | F27B 7/08 | |
| 10,222,122 | B2 * | 3/2019 | Berner | D01F 9/32 | |
| 10,267,562 | B2 * | 4/2019 | Natsume | F26B 25/14 | |
| 10,340,411 | B2 * | 7/2019 | Meyer | F27B 9/2407 | |
| 10,378,819 | B2 * | 8/2019 | Mitomo | F26B 3/347 | |
| 10,646,891 | B2 * | 5/2020 | Zebisch | B05B 16/40 | |
| 10,697,702 | B2 * | 6/2020 | Iglauer | F26B 15/16 | |
| 2018/0120028 | A1 | 5/2018 | Robbin | | |
| 2020/0011599 | A1 * | 1/2020 | Burkart | B05D 3/0413 | |

FOREIGN PATENT DOCUMENTS

| | | | | |
|---|---|---|---|---|
| DE | 102018116358 | A1 * | 1/2020 | F26B 21/04 |
| JP | H04-118168 | U | 10/1992 | |
| WO | 01/53000 | | 7/2001 | |

* cited by examiner

TREATMENT PLANT AND METHOD FOR TREATING WORKPIECES

RELATED APPLICATIONS

The present application claims priority to German Patent Application No. 10 2018 116 358.4 filed Jul. 5, 2018, the contents of which is fully incorporated herein by reference.

FIELD OF THE INVENTION

The invention relates to a treatment plant for treating workpieces, in particular for coating and/or drying vehicle bodies, having a) a treatment device featuring a housing in which a treatment space is accommodated;

b) a conveyor system comprising a multitude of transport trolleys, by means of which the workpieces can be conveyed through the treatment space, wherein each transport trolley comprises a chassis and a fastening device for at least one workpiece, which are coupled together by means of a connecting device;

wherein c) a guiding area with a travel space for the chassis is present outside the treatment space;

d) the travel space is connected to the treatment space via a connecting passage such that the chassis of a transport trolley can move in the driving space and at the same time the fastening device is entrained in the treatment space and the connecting device extends through the connecting passage.

Moreover, the invention relates to a method for the treatment of workpieces, particularly for coating and/or drying vehicle bodies, comprising the passing of workpieces through a treatment space by means of a conveyor system that comprises a multitude of transport trolleys, wherein each transport trolley comprises a chassis and a fastening device for at least one workpiece, which are coupled together by means of a connecting device, and wherein a guide region with a travel space for the chassis is present outside the treatment space, which guide region is connected to the treatment space through a connecting passage such that the chassis of a transport trolley can move in the travel space and at the same time the fastening device is entrained in the treatment space and the connecting device extends through the connecting passage.

BACKGROUND OF THE INVENTION

In such a treatment plant, treatment devices can be present, in particular in the form of coating booths or dryers. In coating booths, the workpieces are provided with a coating and painted, for example; in such a case the treatment space is a coating tunnel or a painting tunnel. In the case of a dryer, the treatment space is accordingly a drying tunnel.

Coating devices can also be present in the form of assembly devices and/or inspection devices, in which the workpieces are assembled or assembly work is performed on the workpieces, or in which the workpieces are inspected in an on-going production process.

The atmosphere of the treatment space may happen to transgress into the travel space through the connecting passage. In particular, in the case of dryers, this atmosphere is contaminated with solvent, which may then condense in the generally cooler travel space and be deposited on the components of the conveyor mechanism in the travel space. This, however, attacks the conveyor system.

Besides this, temperatures prevail in the travel space, especially in the case of dryers, at which the conveyor mechanism located in the travel space is subjected to undesirably high thermal loads.

For a treatment plant and a method of the type mentioned in the introduction, DE 20 2017 106 843 U1 suggests feeding a gas to the travel space, such that gas always flows out from the travel space into the treatment tunnel and not the other way round. The major disadvantage of this is however that, in this manner, impurities from the travel space are carried into the treatment tunnel. These impurities are especially abrasion dust or lubricants of the components of the conveyor system in the travel space. DE 20 2017 106 843 U1 also suggests that the travel space have its own housing and a gas be fed to this under pressure. However, even in such a case, comparatively large volumes of gas need to be moved. Moreover, locks must be provided at the ends of the travel space to maintain the pressure in the travel space even during the movement of the transport trollies in and out; said locks are however involve high outlay in terms of construction simply owing to the required cross section of the travel space.

SUMMARY OF THE INVENTION

An objective of the invention is therefore to provide a treatment plant and a method of the type mentioned in the introduction, which take into account this idea.

This objective may be achieved in the case of a treatment plant of the type mentioned in the introduction in that:

e) the travel space is defined by a travel space housing;

f) a gas device that is present, which is set up such that a throughflow gas, in particular air, can be fed to the travel space and at least a major part of the throughflow gas can again be discharged from the travel space as exhaust gas, without this throughflow gas reaching the treatment space through the connecting passage.

The travel space is flowed through in this manner, so that unwanted components can be discharged and, simultaneously, a cooling effect can be achieved. At the same time, air from the travel space is prevented from being able to enter the treatment space.

It is particularly effective here if the gas device is set up such that the throughflow gas flows through the travel space with one directional component transverse to a direction of movement of the transport trollies.

In addition, it can be advantageous if the gas device is set up such that the throughflow gas flows through the travel space with one directional component parallel to a direction of movement of the transport trollies. This corresponds to oblique flow guidance in relation to the direction of movement of the transport trollies.

The travel space housing has one or more gas inlet ports and one or more gas outlet ports.

Multiple inlets and outlets in each case are favourable in order that the travel space can be flowed through by the throughflow gas selectively and controllably, it is favourable.

Preferably, the gas device is set up such that the volumetric flow rate Q [$m^3s^{-1}$] of the fed throughflow gas is adjustable at one or more gas inlet ports and/or that the volumetric flow rate Q [$m^3s^{-1}$] of the discharged exhaust gas is adjustable at one or more gas outlet ports.

It is advantageous if a) one or more gas inlet ports are connected to a feed pipe system of a feed system, through which throughflow gas can flow to the gas inlet ports, and the feed system features, in the feed pipe system, an active injection device and/or a passive inlet device;
and/or
b) one or more gas outlet ports are connected to a discharge pipe system of a discharge system, through which the exhaust gas can flow away from the gas outlet ports and can be discharged, and the discharge system features, in the discharge pipe system, an active suction device and/or a passive outlet device.

It is favourable here if
a) the active injection device comprises one or more feed blowers;
and/or
b) the passive inlet device comprises one or more inlet valve devices, particularly flap valves, by means of which the flow cross section for the throughflow gas can be changed;
and/or
c) the active suction device comprises one or more discharge blowers;
and/or
d) the passive outlet device comprises one or more outlet valve devices, particularly flap valves, by means of which the flow cross section for the exhaust gas from the travel space can be changed.

If multiple feed blowers and/or multiple discharge blowers are present, it is ensured at the same time that in the event of failure of one or possibly even more blowers, the gas device remains functional, because the remaining functioning blowers can compensate for the defective blowers. For this purpose, the remaining blowers are then operated with correspondingly higher power.

It is advantageous if
a) a feed blower is connected in each case to a single gas inlet port or in each case to multiple gas inlet ports;
and/or
b) an inlet valve device is connected in each case to a single gas inlet port or in each case to multiple gas inlet ports;
and/or
c) a discharge blower is connected in each case to a single gas outlet port or in each case to multiple gas outlet ports;
and/or
d) an outlet valve device is connected in each case to a single gas outlet port or in each case to multiple gas outlet ports.

For an effective utilisation of resources, it is favourable if a conditioning device is present, to which the exhaust gas can be fed, wherein the conditioned gas can be fed to a fresh air feed for the treatment device.

In the case of a method described in the introduction, the above-mentioned objective may be achieved in that the travel space is defined by a travel space housing;

a gas device is present, which is set up such that a throughflow gas, in particular air, is fed to the travel space and at least a major part of the throughflow gas is again discharged from the travel space as exhaust gas, without this throughflow gas reaching the treatment space through the connecting passage.

The advantages of this and of the measures mentioned hereafter correspond to the advantages described for the treatment plant.

It is accordingly favourable if the throughflow gas flows through the travel space with one directional component transverse to a direction of movement of the transport trollies.

In addition, the throughflow gas flows through the travel space with one directional component parallel to a direction of movement of the transport trollies.

The travel space housing preferably features one or more gas inlet ports and one or more gas outlet ports.

The volumetric flow rate Q [$m^3s^{-1}$] of the fed throughflow gas can be adjusted at one or more gas inlet ports (92) and/or the volumetric flow rate Q [$m^3s^{-1}$] of the discharged exhaust gas can be adjusted at one or more gas outlet ports (94).

Likewise, it is favourable if
a) one or more gas inlet ports are connected to a feed pipe system of a feed system, through which throughflow gas flows to the gas inlet ports, and the feed system features, in the feed pipe system, an active injection device and/or a passive inlet device;
and/or
b) one or more gas outlet ports are connected to a discharge pipe system of a discharge system, through which the exhaust gas flows away from the gas outlet ports and is discharged, and the discharge system features, in the discharge pipe system, an active suction device and/or a passive outlet device.

Accordingly, it is also advantageous if
a) the active injection device comprises one or more feed blowers;
and/or
b) the passive inlet device comprises one or more inlet valve devices, particularly flap valves, by means of which the flow cross section for the throughflow gas can be changed;
and/or
c) the active suction device comprises one or more discharge blowers;
and/or
d) the passive outlet device comprises one or more outlet valve devices, particularly flap valves, by means of which the flow cross section for the exhaust gas from the travel space can be changed.

Furthermore, it is advantageous if
a) a feed blower is connected in each case to a single gas inlet port or in each case to multiple gas inlet ports;
and/or
b) an inlet valve device is connected in each case to a single gas inlet port or in each case to multiple gas inlet ports;
and/or
c) a discharge blower is connected in each case to a single gas outlet port or in each case to multiple gas outlet ports;
and/or
d) an outlet valve device is connected in each case to a single gas outlet port or in each case to multiple gas outlet ports.

Advantageously, exhaust gas is fed to a conditioning device and the conditioned gas is fed to a fresh air feed for the treatment device.

Ambient air from the surroundings of the treatment device is used as throughflow gas. As the throughflow gas can only enter the treatment space to a small extent, or not at all, this ambient air does not need to be cleaned or prepared in some other manner.

BRIEF DESCRIPTION OF THE DRAWINGS

Illustrative embodiments of the invention will now be further elucidated by way of the drawings in which.

DETAILED DESCRIPTION OF THE INVENTION

Figure 1:
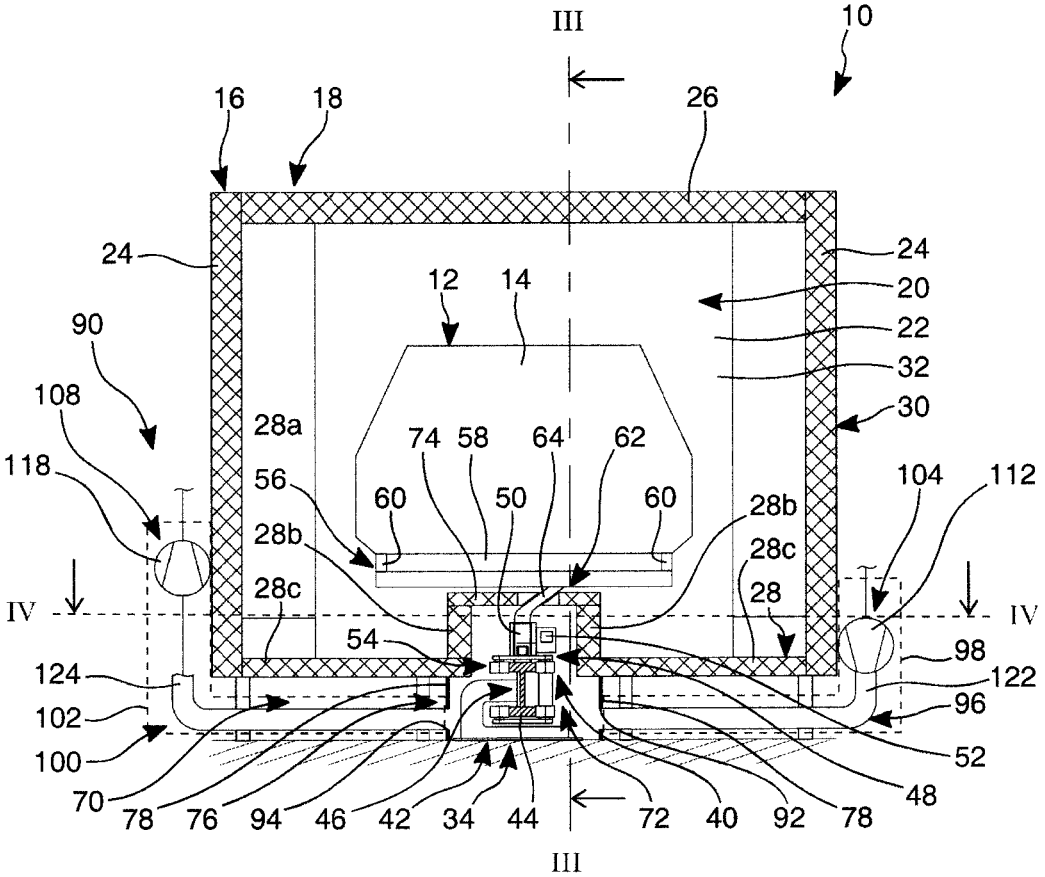
FIG. 1 schematically shows a vertical cross section of a treatment plant with a treatment space and, arranged outside of the treatment space, a guide space with a travel space for a transport system, wherein a first embodiment of a gas device for generating a flow through the travel space is shown, by means of which a throughflow gas can flow into the travel space and can flow out from the travel space as exhaust gas.

While this invention is susceptible to embodiments in many different forms, there is described in detail herein, preferred embodiments of the invention with the understanding that the present disclosures are to be considered as exemplifications of the principles of the invention and are not intended to limit the broad aspects of the invention to the embodiments illustrated.

The figures schematically illustrate a treatment plant, generally designated as 10, for treatment of workpieces 12, which are exemplified as vehicle bodies 14.

The treatment plant 10 comprises a treatment device 16 with a housing 18 in which a treatment space 20 is accommodated, which treatment space is configured as a treatment tunnel 22 and comprises two tunnel walls in the form of side walls 24 and two further tunnel walls in the form of a ceiling 26 and a tunnel floor 28. In a preferred embodiment, described here by way of example, the treatment device 16 is a dryer 30, in which the treatment tunnel 22 defines a drying tunnel 32. The treatment device 16 can, however, also be a coating device, for example, in which the workpieces 14 are coated and, in particular, coated automatically by means of painting robots or manually.

The workpieces 12 are conveyed by means of a conveyor system 34 through the treatment tunnel 22 of the treatment device 16. The treatment device 16 is operated in throughput mode and accordingly has an entrance 36, visible in FIGS. 4 to 9, at one end face end and an exit 38, visible only in FIG. 3, at the opposite end face. Treatment spaces which are designed as a batch system and optionally have only a single access, through which the workpieces 12 are conveyed into the treatment space 20 and also out of it again after the treatment are however also to be understood as treatment tunnel 22 or drying tunnel 32.

The conveyor system 34 comprises a multitude of transport trolleys 40 on which the workpieces 12 are transported. The transport trolleys 40 are moved on a rail system 42. In a modification not specifically shown, the transport trolleys 40 can be designed as free-moving transport trolleys in the sense of driver less transport systems that are familiar to professional experts as so-called FTS.

The present rail system 42 is designed as a single track and comprises a support rail 44, on which a transport trolley 40 moves and which, in the present embodiment, is designed as an I profile, known per se, but can also have other cross sections. The rail system 42 may also be of multi-track, especially two-track, form. The support rail 44 is floor-bound and anchored to a floor, here to the floor of the treatment plant 10.

Each transport trolley 40 comprises a chassis 46 and a drive system 48, which in the present embodiment comprises a drive roller 50 that runs on the support rail 44 and can be driven by a drive motor 52. The transport trolleys 40 can be independently driven in this manner. In the present embodiment, the drive roller 50 runs on the top of the support rail 44. In a modification, the drive roller 50 can also engage on the support rail 44 laterally.

In addition to or instead of the transport trollies 40, elucidated here, each with its own on-board drive system 48, other transport trolleys can also be present, which are driven by a central drive system. For example, such a central drive system can be formed by means of a chain gear or the like. The transport trolleys 40 elucidated here can also be correspondingly driven and moved independently of other drive devices.

In order to prevent the transport trolley 40 from tilting in the direction of transport or transversely to the direction of transport, a support system 54 is provided which has support rollers that rest on the support rail 44 and prevent, in a manner known per se, a corresponding tilting of the transport trolley 40.

The transport trolley 40 comprises a fastening device 56, to which a workpiece 12 or a corresponding workpiece carrier for workpieces 12 can be fastened. For the fastening of vehicle bodies 14, the fastening device 56 in the present embodiment comprises a support profile 58 with bearing pins 60, which interact with counter elements on the vehicle body 14 in a manner known per se, so that the vehicle body 14 can be fixed to the fastening device 56. The fastening device 56 can also feature multiple sets of such bearing pins 60 that are adapted to different vehicle bodies 14 having different dimensions and configurations, such that the fastening device 56 can be flexibly utilized for different types of vehicle bodies. The fastening device 56 thus accommodates a vehicle body 14 directly, without the vehicle body 14 being fastened to a workpiece carrier, such as a skid known per se, for example.

The chassis 46 of the transport trolley 40 is coupled with the fastening device 56 by means of a connecting device 62. In the present embodiment, the connecting device 62 comprises at least one upwardly facing strut 64, wherein, for reasons of stability, two struts 64 are present; each strut 64 present couples the chassis 46 of the transport trolley 40 with the fastening device 56.

The transport trolley 40 can be designed such that it is able to pass through curve sections of the support rail 44. For this purpose, the chassis 46 of the transport trolley 40 may be designed in particular with a forerunner unit 66 and a follower unit 68, which are articulatedly connected together.

In this case, the forerunner unit 66 and the follower unit 68 can each carry a drive roller 50 with drive motor 52 on board.

If the transport trolley 40 is designed for cornering, the coupling between the chassis 46 and the fastening device 56 by means of the connecting device 62 is also set up such that corresponding cornering is possible. For this purpose, the struts 64 are designed, for example, as articulated struts, which allow the fastening device 56 to pivot about a vertical axis of rotation relative to the chassis 46 of the transport trolley 40 by means of a joint. Both the forerunner unit 66 as well as the follower unit 68 may be connected to in each case one strut 64 or to in each case one articulated strut.

The treatment device 16 and the conveyor system 34 are mutually coordinated so that only a part of the conveyor system 34 moves in the treatment space 20, i.e. in the treatment tunnel 22, while the other part of the conveyor system 34 is moved outside the treatment space 20.

For this purpose, outside the treatment space 20, there is provided a guide region 70 with a travel space 72, which is likewise arranged outside the treatment space 20, in which the rail system 42 is accommodated and in which the chassis 46 of a respective transport trolley 40 moves. The treatment space 20 and the guide region 70 or the travel space 72 are separated upwards by a partition 74.

Figure 2:
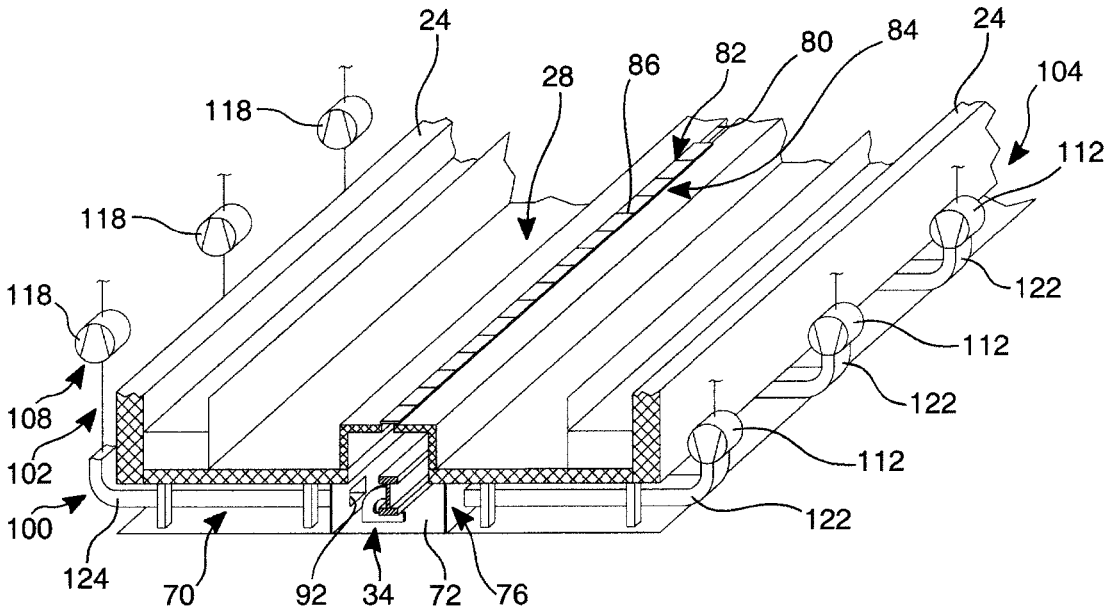
FIG. 2 shows a perspective view of the travel space area of the treatment plant in a section along the section line IV-IV in FIG. 1.
Figure 11:
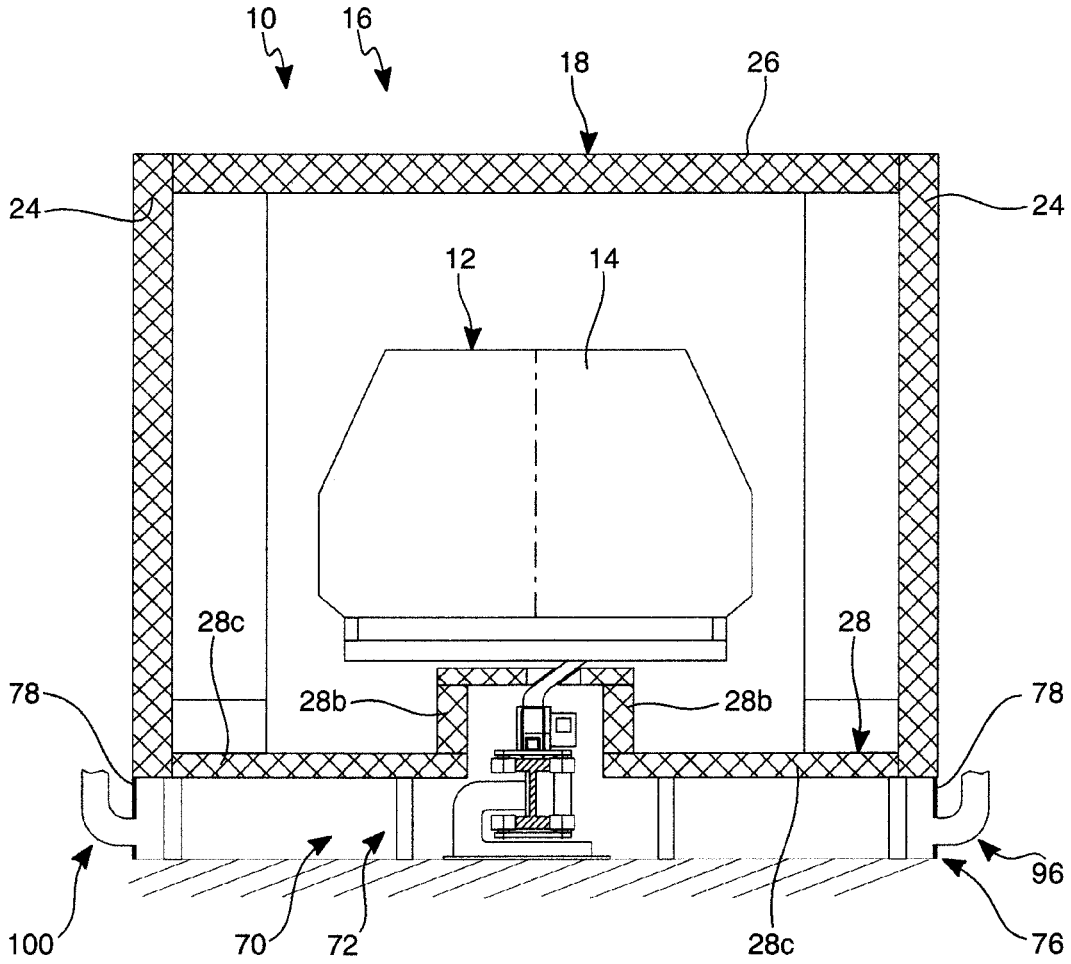
FIG. 11 shows a modification of the travel space.

In the FIGS. 1, 2 and 11, vertical support pillars can be seen between the tunnel floor 28 and the plant floor, which support pillars do not, however, bear their own reference sign.

An arrangement of the guide region 70 "outside" the treatment space 20 is to be understood to mean, that the mentioned partition wall 74 creates a structural separation between the treatment space 20 and the guide region 70.

In the present embodiment, this partition wall 74 is a section 28*a* of the tunnel floor 28, wherein the guide region 62 with the travel space 64 is arranged below this section 28*a* of the tunnel floor 28. In the present embodiment, the tunnel floor 28 as a whole has an angled course and features, laterally adjacent to the section 28*a*, two sections 28*b* which, offset downwards in relation to section 28*a*, at their edges facing the centre of the treatment space 20, are connected by means of in each case one vertical section 28*c* of the tunnel floor 28 to the opposing edges of the section 28*a*.

In this design, the travel space 72, by means of an upper region 72, overlaps the treatment space 20 in cross section, and a lower region of the travel space 72 is arranged at a height level below the sections 28*b* of the tunnel floor 28.

In a modification, the tunnel floor 28 can also be flat, and then a corresponding section 28*a* of the tunnel floor 28 forms the partition wall 74, this section 28*a* then merging laterally directly and in the same horizontal plane into sections 28*c*, without there being vertical sections 28*b*. The travel space 72 is then arranged completely at a height level below the tunnel floor 28.

The travel space 72 is defined, i.e. delimited at least in regions, by a travel space housing 76. In the present exemplary embodiment, the travel space housing 76 comprises the vertical sections 28*c* of the tunnel floor 28 and its section 28*a*, i.e. the partition wall 74 to the treatment space 20. Moreover, the travel space housing 76 also comprises two more housing walls 78 that extend in the longitudinal direction of the treatment space 20 and downwards from the tunnel floor 28. In the illustrative embodiments shown in FIGS. 1 to 10, these further housing walls 78 form approximately a continuation of the vertical sections 28*c* of the tunnel floor 28 downwards. The travel space housing 76 can have a separate housing floor; in the embodiments shown here, a corresponding section of the plant floor assumes this task.

At the end faces of the treatment device 16 at the tunnel entrance 36 or tunnel exit 38, the travel space housing 76 is open. In a modification, locks can also be present there; in any case, it must be possible for the transport trolleys 40 to enter the travel space 72 at the tunnel entrance 36 and to exit the travel space 72 again at the tunnel exit 38. It is at any rate basically not necessary for the travel space housing 76 to be designed to be flow-tight or fluid-tight, wherein this may be provided as a modification.

The travel space 72 is connected to the treatment space 20 via a connecting passage 80 in the partition wall 74. The connecting passage 80 is complementary to the connecting device 62 of the transport trollies 40 and the connecting device 62 extends through the connecting passage 80 such that the fastening device 56 with the workpiece 12 is located in the treatment space 20 and the chassis 46 of a transport trolley 40 is located in the travel space 72.

In the present embodiment, the connecting passage 80 is rectilinear and formed as a straight through passage slot or gap extending between the tunnel entrance 36 and the tunnel exit 38 in the partition wall 74. The connecting passage 80 can also be angular, i.e. designed in a labyrinth-like manner in cross section, for example, in which case the struts 64 are designed to be complementary to it.

Through the connecting passage 80, on the one hand, the tunnel atmosphere contaminated with pollutants, such as solvents and the like, can flow from the treatment space 20 into the travel space 72 and, on the other hand, atmosphere from the travel space 72, which can, for example, be contaminated with abrasion dust or lubricants of the conveyor mechanism in the travel space 72, can enter the treatment space 20. In order to prevent or at least mitigate this, a shielding device 82 is also present.

In the present embodiments, the shielding device 82 comprises an imbricated seal 84, in which a multiplicity of sealing lamellae 86 are arranged in an overlapping manner in the longitudinal direction of the treatment space 20, so as to cover the connecting passage 80 of the partition wall 74. The sealing lamellae 86 are in practice made of a bendable metal sheet or a temperature-resistant bendable plastic. Regardless of the material, the sealing lamellae 86 preferably have a width, i.e. an extent in the longitudinal direction of the treatment space 20, of about 10 cm to 20 cm, preferably 15 cm.

Figure 3:
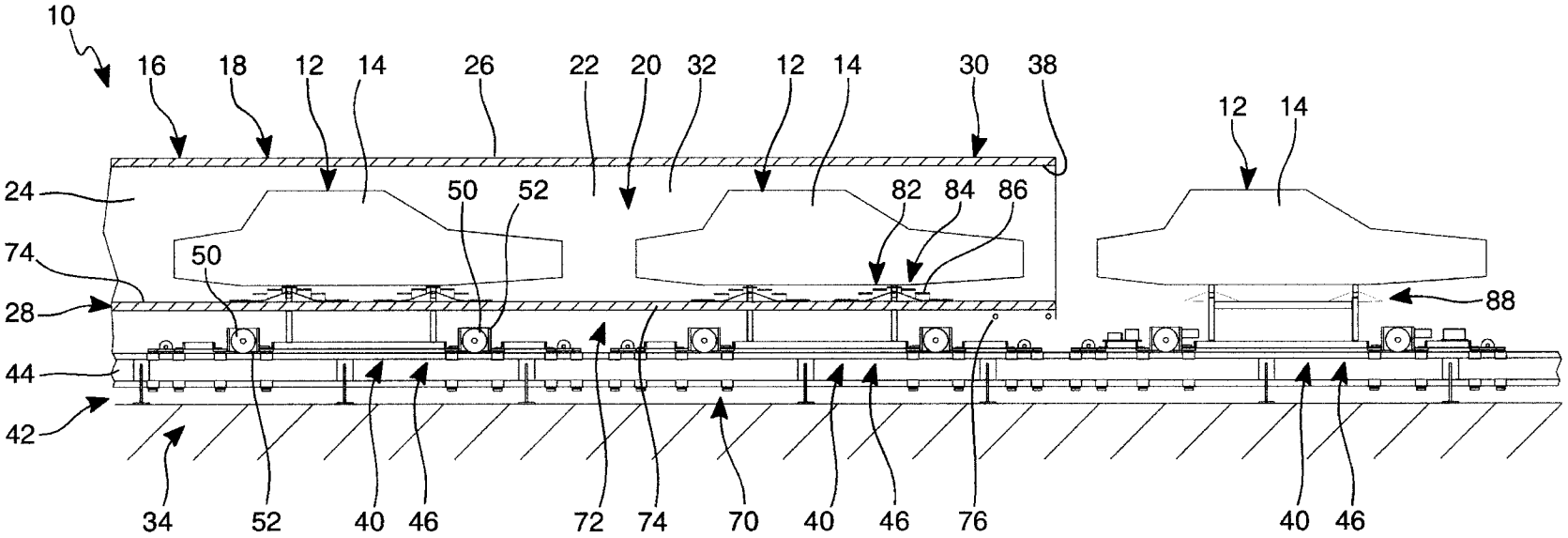
FIG. 3 shows a section of the treatment plant along the section line in FIG. 1.
Figure 4:
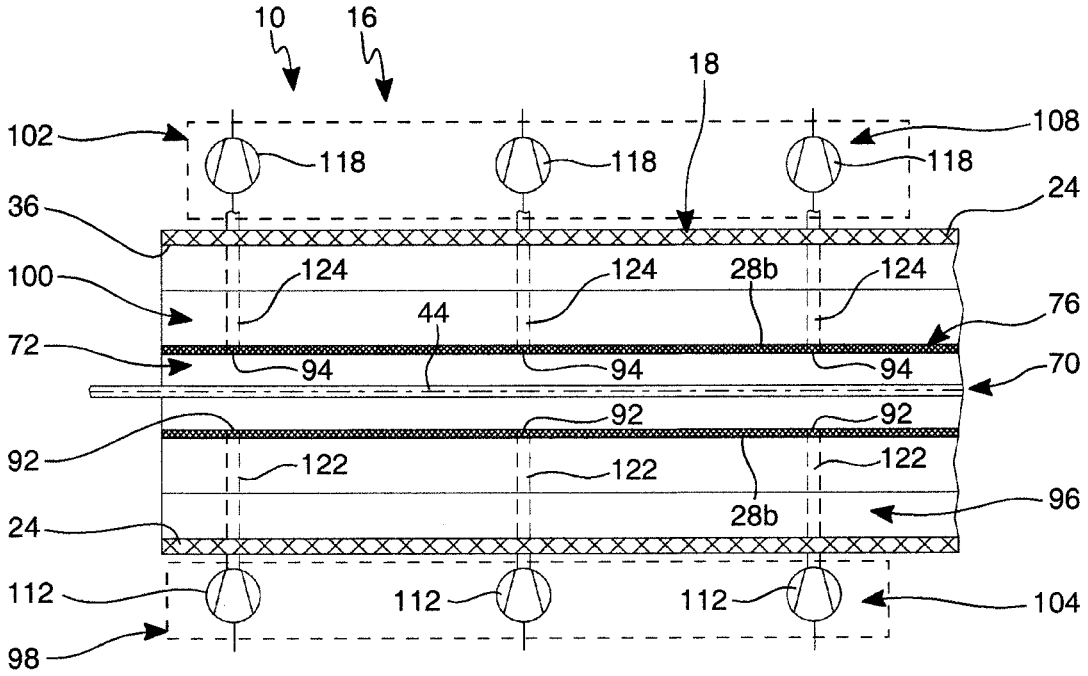
FIG. 4 shows a section of the treatment plant along the section line IV-IV in FIG. 1 with an embodiment of the gas device.

As can be seen in FIG. 3, the transport trolleys 40 carry an adjusting device 88, by means of which the sealing lamellae 86 can be moved when the transport trolley 40 is moved through the treatment device 16. In this case, the sealing lamellae 86 are, at the location and for the duration of the passage of the connecting device 62, i.e. in the present embodiment specifically of the struts 64, moved through the connecting passage 80 from their sealing position on the connecting passage in a release position, in which they can be passed by the transport trolley 40.

When the transport trolley 40 thus enters the treatment device 16, the articulated struts 64 enter the connecting passage 80, the adjusting device 88 pushing the sealing lamellae 86 out of the way, so that a corresponding passage window between the travel space 72 and the treatment space 20 is always only present in the area of the articulated struts 64.

In the context of sealing lamellae, the professional expert knows the jargon term of a "lamella opener". Such lamella openers are known and are used to push the lamellae of imbricated seals, in particular on slots sealed by the latter, to the side. The adjusting device 88 is accordingly designed in the manner of such a lamella opener.

A gas device 90 is present, which is set up such that a throughflow gas, in particular air, can be fed to the travel space 72 and at least a major part of the throughflow gas can again be discharged from the travel space 72 as exhaust gas, without this throughflow gas, i.e. this major part of the throughflow gas, reaching the treatment space 20 through the connecting passage 80. Ideally, the throughflow gas is completely discharged as exhaust gas from the travel space 72. At least only a volume fraction of the throughflow gas may pass from the travel space 72 into the treatment space 20 which does not cause any damage or loss of quality of the treatment result in the treatment space 20.

It may indeed be unavoidable that, depending on local pressure and flow conditions in the travel space 72, a fraction of the throughflow gas may happen to pass through the connecting passage 80 upwards into the treatment space 20. As mentioned, this is however not the case for the major part of the fed throughflow gas.

On the one hand, the travel space 72 can be cooled in this manner in comparison to the temperature conditions in the treatment space 20, so that the conveyor mechanism located in the travel space 72 and in particular the transport trollies 40 are, when passing through the travel space 72, subjected to no thermal loads or to at least lower thermal loads than without the gas feed device 90. In this case, the throughflow gas is thus a cooling gas or serves as a cooling gas in this case.

On the other hand, aggressive or otherwise undesirable components, which may pass through the connecting passage 80 from the treatment space 20 into the travel space 72 due to an atmosphere transfer and can also place a burden on conveyor mechanism there, can be removed from the travel space 72, because these components are entrained by the throughflow gas and discharged with the exhaust gas from the travel space 72. In this case, the throughflow gas is consequently a purge gas or serves as a purge gas in this case.

The gas device 90 is set up such that the throughflow gas flows through the travel space 72 with one directional component transverse to a direction of movement of the transport trollies 40.

The travel space housing 76 includes one or more gas inlet ports 92, hereinafter designated as gas inlets 92, and one or more gas outlet ports 94, hereinafter designated as gas outlets 94. In the presently described embodiments, multiple gas inlets 92 and multiple gas outlets 94 are provided. If only a single gas inlet 92 and/or a single gas outlet 94 is to be provided, these can be formed, for example, as slot opening over the length of the travel space 72. The air distribution in the travel space 72 can be effected in this case, for example, by means of adjustable sliding plates in the travel space 72 or at the slot openings.

The gas inlets 92 are connected to a feed pipe system 96 of a feed system 98, through which throughflow gas can flow to the gas inlets 94. The gas outlets 94 are connected to a discharge pipe system 100 of a discharge system 102, through which the exhaust gas can flow away from the gas outlets 94 and can be discharged.

The feed system 96 draws the throughflow gas from the ambient air of the treatment device 16; the throughflow gas is in this case thus feed air and the exhaust gas is mainly exhaust air. For this purpose, the feed pipe system 96 is fluidically connected to the surroundings of the treatment device 16 on the input side through one or more accesses. The used ambient air need not be filtered or conditioned in any other way.

The gas device 90 is set up such that the volumetric flow rate Q [$m^3s^{-1}$] of the fed throughflow gas can be adjusted at one or more gas inlet ports 92 and/or the volumetric flow rate Q [$m^3s^{-1}$] of the discharged exhaust gas can be adjusted at one or more gas outlet ports 94.

For this purpose, the feed system 98 comprises, in the feed pipe system 96, an active injection device 104 and/or a passive inlet device 106 and/or, i.e. additionally or alternatively, the discharge system 102 comprises, in the discharge pipe system 100, an active suction device 108 and/or a passive outlet device 110. The passive inlet device 106 and the passive outlet device 110 are designated in FIGS. 5 and 7.

An active injection device 104 comprises one or more feed blowers 112. In this case, a feed blower 112 that is present can be connected in each case to a single gas inlet 92 or in each case to a plurality of gas inlets 92, for which purpose the feed pipe system 96 is designed to be correspondingly complementary. Thus, in two extreme cases, on the one hand, a single feed blower 112 can be provided for all gas inlets 92 or, on the other hand, each gas inlet 92 can be assigned its own feed blower 112.

A passive inlet device 106 comprises one or more inlet valve devices 114, by means of which the flow cross section for the throughflow gas can be changed. In the figures, such inlet valve devices 114 are illustrated as flap valves 116. A inlet valve device 114 that is present can be connected in each case to a single gas inlet 92 or in each case to a plurality of gas inlets 92, for which purpose the feed pipe system 96 is designed to be correspondingly complementary. Thus, in two extreme cases, on the one hand, a single inlet valve device 114 can be provided for all gas inlets 92 or, on the other hand, each gas inlet 92 can be assigned its own inlet valve device 114.

An active suction device 108 comprises one or more discharge blowers 118. In this case, a discharge blower 118 that is present can be connected in each case to a single gas outlet 94 or in each case to a plurality of gas outlets 94, for which purpose the discharge pipe system 100 is designed to be correspondingly complementary. Thus, in two extreme cases, on the one hand, a single discharge blower 118 can be provided for all gas outlets 94 or, on the other hand, each exhaust gas outlet 94 may be assigned its own discharge blower 118.

A passive exhaust device 110 comprises one or more outlet valve devices 120, by means of which the flow cross section for the exhaust gas from the travel space 72 can be changed. In the figures, such outlet valve devices 120 are likewise illustrated as flap valves 116. An outlet valve device 120 that is present can be connected in each case to a single gas outlet 94 or in each case to a plurality of gas outlets 94, for which purpose the discharge pipe system 100 is designed to be correspondingly complementary. Thus, in two extreme cases, on the one hand, a single outlet valve device 120 can be provided for all gas outlets 94 or, on the other hand, each gas outlet 94 may be assigned its own outlet valve device 120.

As already elucidated in the introduction, a safety system is also established at the same time with multiple feed blowers 112 and/or multiple discharge blowers 118, because in the event of failure of one or possibly even more of the blowers 112, 118 that are present, the gas device 90 remains functional, because the remaining functioning blowers 112, 118 can compensate for this/these defective blower(s) 112, 118. For this purpose, the remaining blowers 112, 118 are operated with correspondingly higher power.

In the embodiment of FIGS. 1-4, the feed system 98 includes a separate feed blower 112 for each gas inlet 92. There, the feed pipe system 96 includes a separate feed pipe 122 between each feed blower 112 and the respectively associated gas inlet 92. There is no passive inlet device 106.

Similarly, the discharge system 102 comprises a separate discharge blower 118 for each gas outlet 94. There, the discharge pipe system 100 comprises a separate discharge pipe 124 between each gas outlet 94 and the respectively associated discharge blower 118. There is no passive outlet device 110.

The volumetric flow rate at each gas inlet 92 or at each gas outlet 94 can be adjusted there by separately controlling the power for each feed blower 112 or for each discharge blower 118. This can for example be done by means of frequency converters, as is known per se. Such an individual actuation of the present blowers 112 or 118 respectively is also possible in all other described embodiments and variants.

Figure 5:
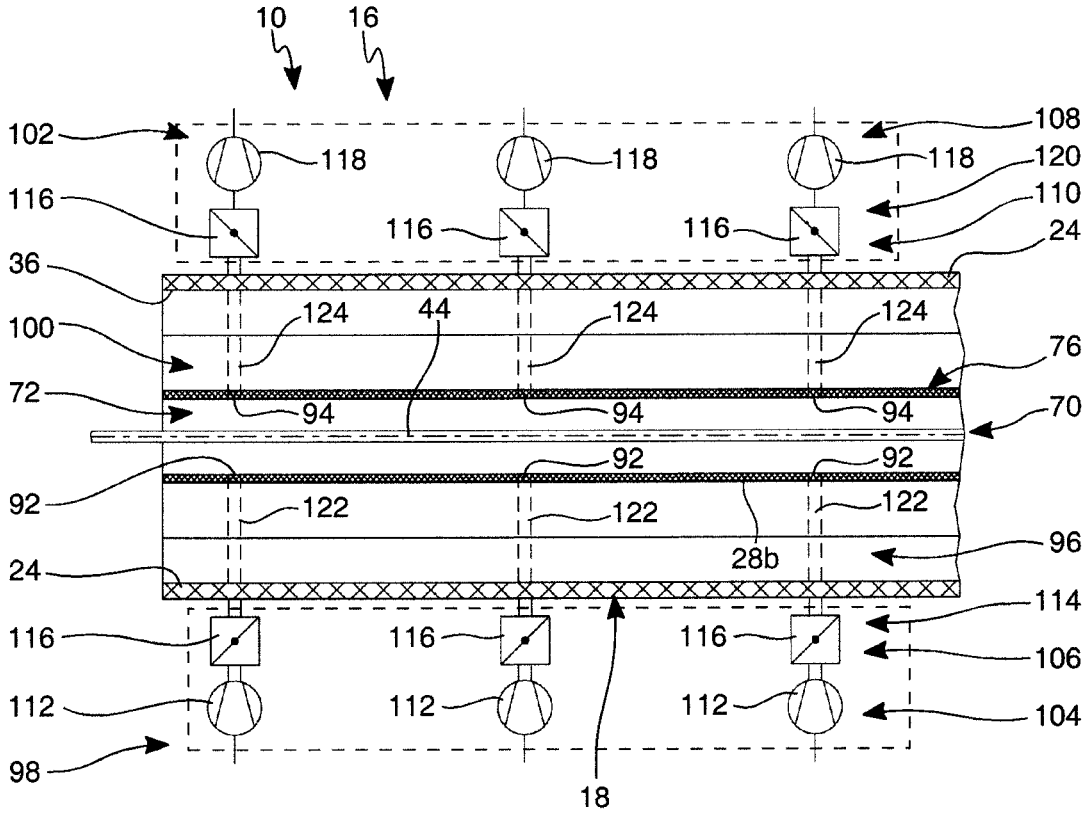
FIG. 5 shows a section of the treatment plant along the section line IV-IV in FIG. 1 with an embodiment of the gas device.

In the embodiment according to FIG. 5, the passive inlet device 104 and the passive outlet device 110 are additionally present. There, a flap valve 116 is arranged in each separate feed pipe 122 and in each separate discharge pipe 124. The position of the flap valves can be upstream or downstream of the respective feed blower 112 or discharge blower 118.

Figure 6:
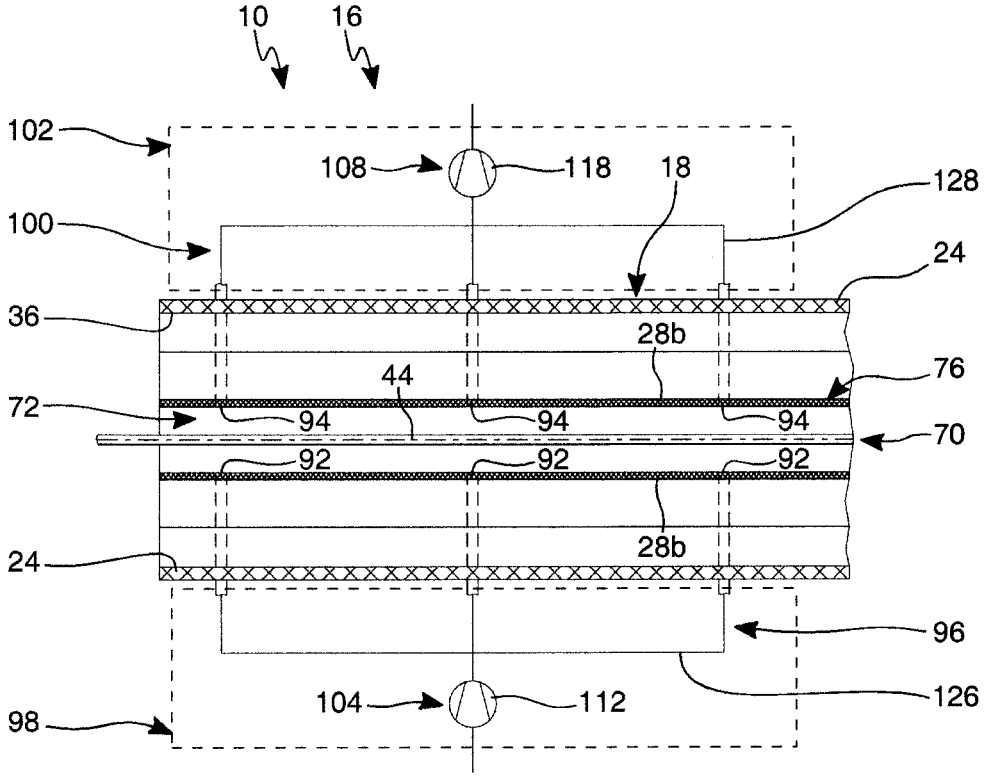
FIG. 6 shows a section of the treatment plant along the section line IV-IV in FIG. 1 with an embodiment of the gas device.

FIG. 6 shows an exemplary embodiment in which the feed system 98 features one feed blower 112 for multiple gas inlets 92. There, by way of example, three gas inlets 92 are connected as a group via a multi-arm feed pipe 126, with three arms in this case, to the feed blower 112. If only two or more than three gas inlets 92 interact with a common feed blower 112, the multi-arm feed pipe 126 has accordingly two or more than three arms.

Similarly, the discharge system 102 comprises one discharge blower 118 for multiple gas outlets 94. There, by way of example, it is likewise the case that three gas outlets 94 are connected as a group via a multi-arm discharge pipe 128, with three arms in this case, to the discharge blower 118. If only two or more than three gas outlets 94 interact with a common discharge blower 11, the multi-arm discharge pipe 128 has accordingly two or more than three arms. In this arrangement, the volumetric flow rate can only be adjusted in groups at the gas inlets 92 or at the gas outlets 94, which are connected to a controllable blower 112 and 118 respectively.

Figure 7:
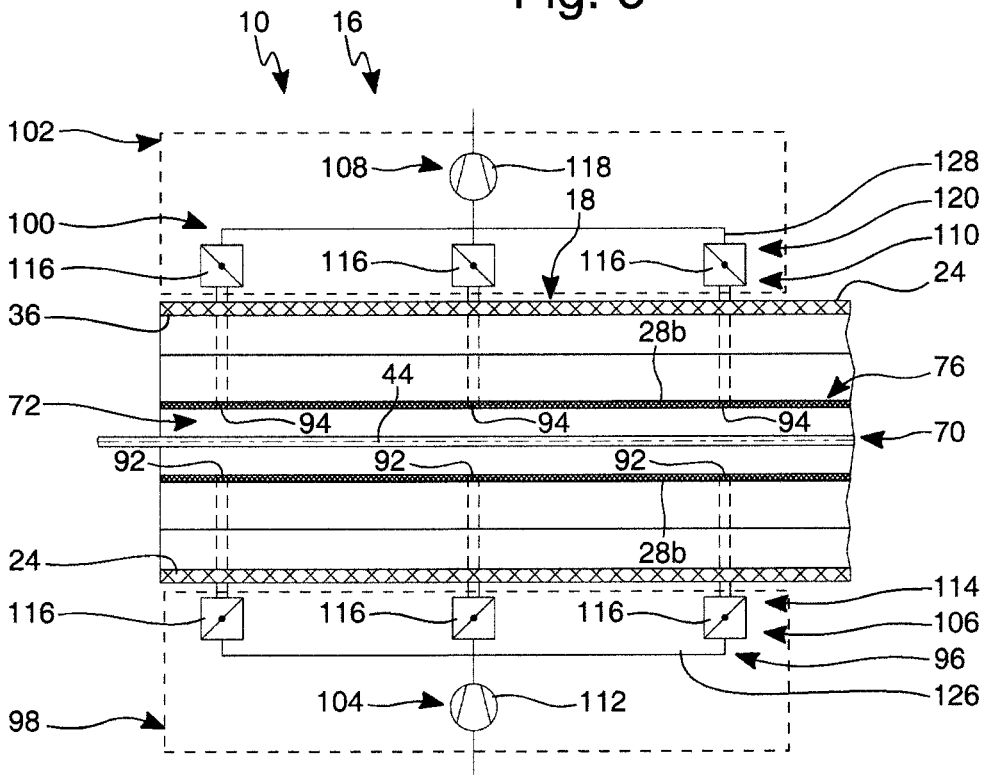
FIG. 7 shows a section of the treatment plant along the section line IV-IV in FIG. 1 with an embodiment of the gas device.

In the embodiment shown in FIG. 7, the passive inlet device 106 and the passive outlet device 110 are again additionally provided, by arrangement of a flap valve 122 in each arm of the multi-arm discharge pipe 128. In this manner, despite a common feed blower 112 or discharge blower 118, the volumetric flow rate can be individually set at each gas inlet 92 or gas outlet 94 by adjusting the associated flap valves 122 accordingly.

If the discharge system 102 includes the active suction device 108, the feed system 98 can also include only the feed pipe system 96 without the passive inlet device 106 or the feed pipe system 96 with the passive inlet device 106, in each case without an active injection device 104 being present. These modifications are not specifically shown in the figures.

If, in a similar manner, the feed system 98 includes the active injection device 104, the discharge system 102 can also include only the discharge pipe system 100 without the passive outlet device 110 or the discharge pipe system 100 with the passive outlet device 110, in each case without an active suction device 108 being present. These modifications are also not specifically shown in the figures.

In the embodiments shown in FIGS. 1 to 7, the gas inlets 92 and the gas outlets 94 are in each case arranged oppositely in a direction transverse to the transport direction.

Figure 8:
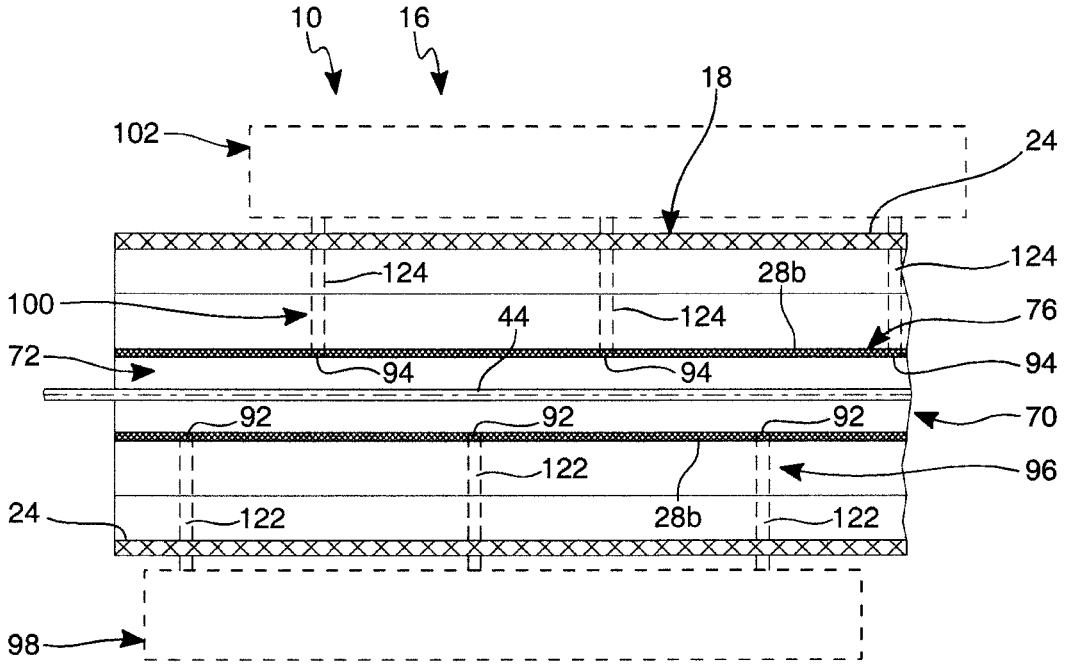
FIG. 8 shows a section of the treatment plant along the section line IV-IV in FIG. 1 with an embodiment of the gas device.
Figure 9:
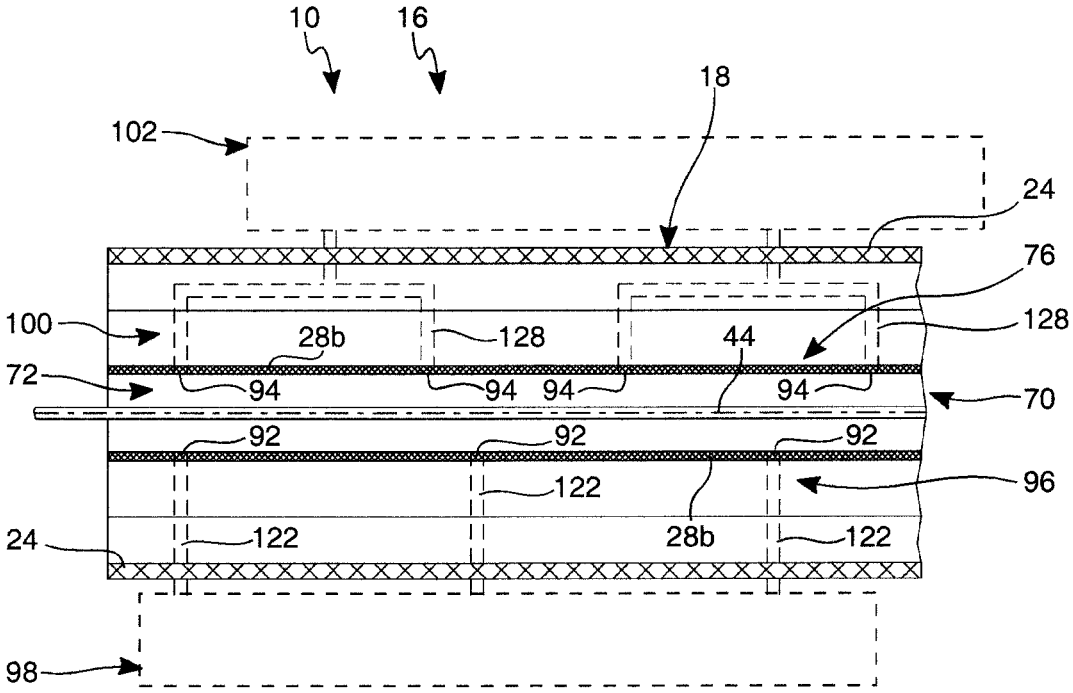
FIG. 9 shows a cutout of the section of FIG. 3, wherein a conditioning device for the exhaust gas coming from the travel space is shown.

FIGS. 8 and 9 show embodiments in which the gas inlets 92 and the gas outlets 94 are arranged mutually offset in the transport direction. FIG. 8 illustrates a regularly alternating arrangement, in which the spacings of the gas inlets 92 and of the gas outlets 94 in the transport direction are the same. By way of example, the separate feed pipes 122 and the separate discharge pipes 124 are present there. FIG. 9 illustrates an asymmetrical arrangement, in which the spacings of the gas inlets 92 and of the gas outlets 94 in the transport direction are irregular and not always equal. By way of example, the separate feed pipes 122 are shown there in combination with the multi-arm discharge pipes 128, which in the exemplary embodiment according to FIG. 9 are designed as a two-arm variant.

In the case of such an effort of the gas inlets 92 and the gas outlets 94, the throughflow gas also flows with a directional component parallel to the direction of movement of the transport trollies 40, wherein this directional component can point in or oppositely to the direction of movement of the transport trollies 40. An improved flow around the conveyor mechanism in the travel space 72 is achieved in this way.

Figure 10:
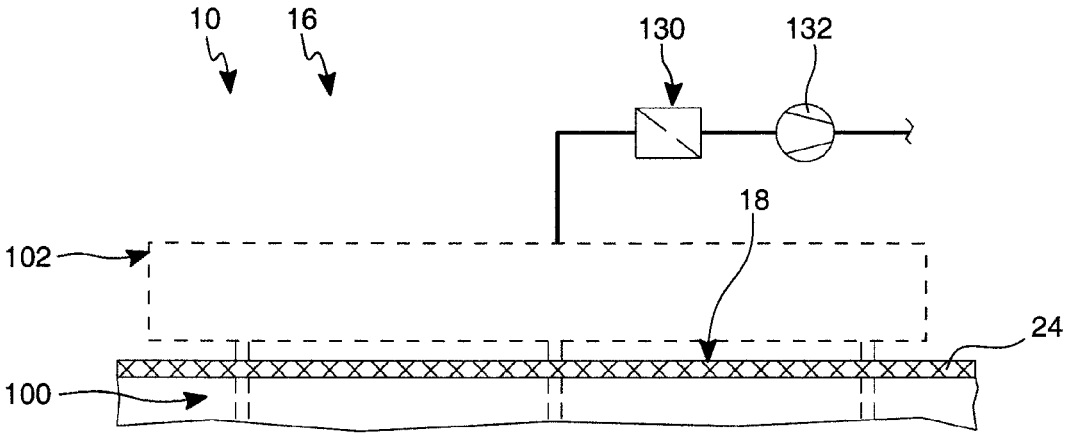
FIG. 10 shows a cross section of the treatment plant corresponding to FIG. 1 with modified travel space.

As illustrated in FIG. 10, the exhaust gas discharged from the travel space 72 can be guided through a conditioning device 130, which is connected to the discharge system 102 or to its discharge pipe system 100. The conditioning device 130 can possibly be assigned to a supporting delivery blower 132, which can even be located upstream of the conditioning device 130, differing from the position shown in FIG. 10.

The conditioning device 130, for example, filters out impurities from the exhaust gas. This conditioned gas is then of a sufficient quality that it can be fed to a fresh air feed for the treatment device 16, in particular for the dryer 30, and, in this way, to the process in the treatment device 16. Here, in the case of a dryer 30, the conditioned gas is heated in a fresh air heat exchanger, as is known per se.

In order to monitor the temperature conditions in the travel space 72, temperature sensors can be provided there, so that a temperature profile of the travel space 72 can be generated. Depending on local sensor responses, the volumetric flow rate can be changed and adjusted at certain gas inlets 92 and/or gas outlets 94 by actuating the present active and passive devices 104, 108 and 106, 110 respectively, i.e. in this case specifically the present blowers 112, 118 and/or the flap valves 122, such that the desired temperature distribution in the travel space 72 is ensured.

The components and parts of the gas device 90 can be attached, at least partially, to the side walls 24 of the treatment device 16. In one variant, it is ensured that these components and parts are accommodated in the spatial regions of the guide region 62 next to the travel space housing 76, so that they are arranged within the outer contour of the treatment device 16 projected on to the installation surface of the treatment device 16.

FIG. 11 shows one more modification of the travel space housing 76, in which the housing walls 78 are arranged further outwards and approximately form a downward continuation of the side walls 24 of the treatment device 16. In this case, the sections 28*c* of the tunnel floor 28 also form part of the travel space housing 76.

While all gas inlets 92 and all gas outlets 94 in the embodiments shown are each arranged on one side of the travel space housing 76, it is possible in a modification not specifically shown for both gas inlets 92 and gas outlets 94 to be provided on each side of the travel space 76, to which gas inlets and gas outlets the feed pipe system 96 and the discharge pipe system 100 are adapted accordingly.

Depending on the design of the gas device 90, the volumetric flow rate Q [$m^3s^{-1}$] can, at the gas inlets 92 and the gas outlets 94, be tuned for the operation of the treatment device 16 and in particular follow the path of a specific transport trolley 40 through the travel space 72.

When a transport trolley 40 moves along the connecting passage 80, it is unavoidable that a concomitantly moving passage window opens between the travel space 72 and the treatment space 20 in the region of the connecting device 62, namely in the region of the struts 64, when the sealing lamellae 86 of the shielding device 82 are deflected upward. A relatively intense heat transfer and a relatively great atmosphere transfer from the treatment space 20 into the travel space 72 can occur through this passage window.

If, locally where a certain transport trolley 40 is located, the volumetric flow rate Q is temporarily increased at gas inlets 92 present there, more heat can be dissipated from the throughflow gas. The atmosphere flowing into the travel space 72 from the treatment space 20 can also be effectively dissipated locally in this manner.

By appropriately actuating the gas device 90 or the feed system 98 and/or the discharge system 102, it is possible to achieve that, at the connecting passage 80 between the treatment space 20 and the travel space 20, no pressure difference prevails which would cause atmosphere to transgress from one space into the other. Ideally, balanced pressure conditions prevail, in particular at the said passage windows.

By means of the gas device 90, it is at least locally possible for a pressure to be generated which at least largely corresponds to the local pressure in the treatment space 20 on the other side of the connecting passage.

While this invention is susceptible to embodiments in many different forms, there is described in detail herein, preferred embodiments of the invention with the understanding that the present disclosures are to be considered as exemplifications of the principles of the invention and are not intended to limit the broad aspects of the invention to the embodiments illustrated.

What is claimed is:

1. A treatment plant for treating workpieces comprising:

a) a treatment device featuring a housing in which a treatment space is accommodated;

b) a conveyor system comprising a multitude of transport trolleys, by means of which workpieces can be conveyed through the treatment space, wherein each transport trolley comprises a chassis and a fastening device for at least one workpiece, which are coupled together by means of a connecting device;

wherein, c) a guiding area with a travel space for the chassis is present outside the treatment space;

d) the travel space is connected to the treatment space via a connecting passage such that the chassis of a transport trolley can move in the travel space and while the fastening device is entrained in the treatment space and the connecting device extends through the connecting passage, further wherein, e) the travel space is defined by a travel space housing; and f) a gas device is present, which is set up such that a throughflow gas can be fed to the travel space and at least a major part of the throughflow gas can again be discharged from the travel space as an exhaust gas, without the exhaust gas reaching the treatment space through the connecting passage.

2. The treatment plant according to claim 1, wherein the gas device is set up such that the throughflow gas flows through the travel space with one directional component transverse to a direction of movement of the transport trolleys.

3. The treatment plant according to claim 2, wherein the gas device is set up such that the throughflow gas flows through the travel space with one directional component parallel to a direction of movement of the transport trolleys.

4. The treatment plant according to claim 1, wherein the travel space housing features one or more gas inlet ports and one or more gas outlet ports.

5. The treatment plant according to claim 4, wherein the gas device is set up such that a volumetric flow rate of the throughflow gas is adjustable at one or more gas inlet ports and/or that a volumetric flow rate of the exhaust gas is adjustable at one or more gas outlet ports.

6. The treatment plant according to claim 4, wherein a) one or more gas inlet ports are connected to a feed pipe system of a feed system, through which throughflow gas can flow to the gas inlet ports, and the feed system features, in the feed pipe system, an active injection device and/or a passive inlet device;

and/or b) one or more gas outlet ports are connected to a discharge pipe system of a discharge system, through which the exhaust gas can flow away from the gas outlet ports and can be discharged, and the discharge system features, in the discharge pipe system, an active suction device and/or a passive outlet device.

7. The treatment plant according to claim 6, wherein a) the active injection device comprises one or more feed blowers;

and/or b) the passive inlet device comprises one or more inlet valve devices by means of which a flow cross section for the throughflow gas can be changed;

and/or c) the active suction device comprises one or more discharge blowers;

and/or d) the passive outlet device comprises one or more outlet valve devices by means of which a flow cross section for the exhaust gas from the travel space can be changed.

8. The treatment plant according to claim 7, wherein a) a feed blower is connected in each case to a single gas inlet port or in each case to multiple gas inlet ports of the one or more gas inlet ports;

and/or b) an inlet valve device is connected in each case to a single gas inlet port or in each case to multiple gas inlet ports of the one or more gas inlet ports;

and/or c) a discharge blower is connected in each case to a single gas outlet port or in each case to multiple gas outlet ports of the one or more gas outlet ports;

and/or d) an outlet valve device is connected in each case to a single gas outlet port or in each case to multiple gas outlet ports of the one or more gas outlet ports.

9. Treatment plant according to claim 1, further comprising a conditioning device to which the exhaust gas can be fed, wherein the conditioned gas can be fed to a fresh air feed for the treatment device.

10. A method for treating comprising:

passing workpieces through a treatment space by means of a conveyor system that comprises a multitude of transport trolleys, wherein each transport trolley comprises a chassis and a fastening device for at least one workpiece, which are coupled together by means of a connecting device, and wherein a guide region with a travel space for the chassis is present outside the treatment space, which guide region is connected to the treatment space through a connecting passage such that the chassis of a transport trolley can move in the travel space, while the fastening device is entrained in the treatment space and the connecting device extends through the connecting passage, wherein the travel space is defined by a travel space housing; and a gas device is present, which is set up such that a throughflow gas is fed to the travel space and at least a major part of the throughflow gas is again discharged from the travel space as an exhaust gas, without the exhaust gas reaching the treatment space through the connecting passage.

11. The method according to claim 10, wherein the throughflow gas flows through the travel space with one directional component transverse to a direction of movement of the transport trollies.

12. The method according to claim 11, wherein the throughflow gas flows through the travel space with one directional component parallel to a direction of movement of the transport trollies.

13. The method according to claim 10, wherein the travel space housing features one or more gas inlet ports and one or more gas outlet ports.

14. The method according to claim 13, wherein a volumetric flow rate of the throughflow gas can be adjusted at one or more gas inlet ports and/or a volumetric flow rate of the exhaust gas can be adjusted at one or more gas outlet ports.

15. The method according to claim 13, wherein a) one or more gas inlet ports are connected to a feed pipe system of a feed system, through which throughflow gas flows to the gas inlet ports, and the feed system features, in the feed pipe system, an active injection device and/or a passive inlet device;

and/or b) one or more gas outlet ports are connected to a discharge pipe system of a discharge system, through which the exhaust gas flows away from the gas outlet ports and is discharged, and the discharge system features, in the discharge pipe system, an active suction device and/or a passive outlet device.

16. The method according to claim 15, wherein a) the active injection device comprises one or more feed blowers;

and/or b) the passive inlet device comprises one or more inlet valve devices by means of which a flow cross section for the throughflow gas can be changed;

and/or c) the active suction device comprises one or more discharge blowers;

and/or d) the passive outlet device comprises one or more outlet valve devices by means of which a flow cross section for the exhaust gas from the travel space can be changed.

17. The method according to claim 16, wherein a) a feed blower is connected in each case to a single gas inlet port or in each case to multiple gas inlet ports of the one or more gas inlet ports;

and/or b) an inlet valve device is connected in each case to a single gas inlet port or in each case to multiple gas inlet ports of the one or more gas inlet ports;

and/or c) a discharge blower is connected in each case to a single gas outlet port or in each case to multiple gas outlet ports of the one or more gas outlet ports;

and/or d) an outlet valve device is connected in each case to a single gas outlet port or in each case to multiple gas outlet ports of the one or more gas outlet ports.

18. The method according to claim 10, wherein exhaust gas is fed to a conditioning device and the conditioned gas is fed to a fresh air feed for the treatment device.

19. The method according to claim 10, wherein ambient air from outside the treatment device is used as throughflow gas.

* * * * *